US009307845B2

(12) United States Patent
Krass

(10) Patent No.: US 9,307,845 B2
(45) Date of Patent: Apr. 12, 2016

(54) MULTIFUNCTION BABY CARRIER EXERCISE DEVICE

(71) Applicant: Scott Krass, San Diego, CA (US)

(72) Inventor: Scott Krass, San Diego, CA (US)

( * ) Notice: Subject to any disclaimer, the term of this patent is extended or adjusted under 35 U.S.C. 154(b) by 0 days.

(21) Appl. No.: 14/219,777

(22) Filed: Mar. 19, 2014

(65) Prior Publication Data

US 2015/0265066 A1 Sep. 24, 2015

(51) Int. Cl.
*A47D 13/02* (2006.01)
*A63B 21/06* (2006.01)

(52) U.S. Cl.
CPC ..... *A47D 13/02* (2013.01); *A63B 21/0601* (2013.01)

(58) Field of Classification Search
CPC ..... A47D 13/02
USPC ..... 224/158–161; D3/213, 214
See application file for complete search history.

(56) References Cited

U.S. PATENT DOCUMENTS

| | | | | | |
|---|---|---|---|---|---|
| 2,551,509 | A | * | 5/1951 | Smith | 294/140 |
| 2,554,340 | A | * | 5/1951 | Maxwell | 294/140 |
| 2,628,358 | A | * | 2/1953 | Neils | 2/69.5 |
| 3,096,917 | A | * | 7/1963 | Gudiksen | 294/140 |
| D200,759 | S | * | 4/1965 | Caswell | D3/213 |
| 3,968,911 | A | * | 7/1976 | Haas | 224/158 |
| D253,557 | S | * | 12/1979 | Thompson | D3/213 |
| 4,254,900 | A | * | 3/1981 | Wheeler | 224/158 |
| 4,262,385 | A | * | 4/1981 | Norman | 16/411 |
| 4,717,056 | A | * | 1/1988 | Carmichael | 224/158 |
| 4,730,759 | A | * | 3/1988 | Naidu | 224/158 |
| D319,921 | S | * | 9/1991 | Philipak | D3/213 |
| D332,175 | S | * | 1/1993 | Beplate | D3/213 |
| D332,865 | S | * | 2/1993 | Wilmink | D3/213 |
| 5,333,769 | A | * | 8/1994 | Skroski | 224/158 |
| D407,213 | S | * | 3/1999 | McConnell | D3/213 |
| 6,415,969 | B1 | * | 7/2002 | Higuchi | 224/160 |
| 8,505,789 | B2 | * | 8/2013 | Green | 224/158 |
| 9,066,609 | B2 | * | 6/2015 | Starr | A47D 13/02 |
| 2005/0178631 | A1 | * | 8/2005 | Fenton | 190/109 |
| 2008/0313812 | A1 | * | 12/2008 | Reeves et al. | 5/655 |
| 2011/0042429 | A1 | * | 2/2011 | Frost | 224/159 |
| 2012/0018466 | A1 | * | 1/2012 | Topaz | A61G 1/01 224/158 |
| 2014/0296045 | A1 | * | 10/2014 | Krstanoski-Blazeski | 482/139 |

OTHER PUBLICATIONS

Baby Bicep Curls, YouTube, Jan. 12, 2013.*
Baby Barbells Teaches Dads How to Use Babies as Gym Equipment, Odditcentral.com, Jul. 7, 2011.*
How to Use Your Baby as Piece of Exercise Equipment, Artofmanliness.com, Dec. 8, 2014.*
New Year, New Mom! Tackle Your Trouble Spots: Tummy, Jan. 1, 2014.*
New Year, New Mom! Tackle Your Trouble Spots: Arms, Ergobaby.com, Jan. 22, 2014.*
Baby-robics, Fotdickens.blogspot.com, Jul. 2, 2012.*
Snugglebundl, "The Snugglebundl baby lifting wrap", Web Page, retrieved on Dec. 2, 2015 from http://www.snugglebundl.co.uk/, 2 Pages.
Puckababy, "Baby sleeping bag", Web Page, retrieved on Dec. 2, 2015 from http://puckababy.com.au/, 1 Page.

* cited by examiner

*Primary Examiner* — Justin Larson
(74) *Attorney, Agent, or Firm* — Dittavong & Steiner, P.C.

(57) ABSTRACT

A multi-function baby carrier is disclosed. The baby carrier is designed to be lightweight and portable, so as to support a baby safely and securely, with the capability of being held with a single hand, acting as a portable baby swing, and also providing a resistance-training weight for a user.

13 Claims, 9 Drawing Sheets

100

MULTIFUNCTION BABY CARRIER EXERCISE DEVICE

TECHNICAL FIELD

The present disclosure relates to a device for accommodating an animal, such as a human baby. The present disclosure is particularly applicable to a multifunction carrying device configured for use as an exercise device while accommodating a baby.

BACKGROUND

The care of a newborn baby is virtually a 24 hour a day job, leaving very little time for new parents to engage in traditional exercise. The lack of exercise runs contrary to traditional and prevailing medical opinions. Moreover, many individuals have incorporated exercise into a regular routine. Conventional exercise devices, such as universal machines, are capable of targeting certain muscle groups of a user, while routines are known for use with free weights and cables to target desired muscle groups.

Conventional baby carriers, such as car seats are designed for lengthy transportation and prolonged transport. They are typically bulky and heavy owing to the goal of protecting the baby in the event of an automobile accident. Such baby carriers, or car seats, are ill-suited to providing the user carrying the baby carrier to engage in a physical workout session as might be provided, for example, by free weights and/or machines at a gym.

Other conventional baby carriers, such as hands-free baby carriers, are typically strapped on a user's back or across the front of a user's body. These are complicated, time consuming to place on the body and adjust, bulky to wear, and unwieldly. These also are not easily used as an exercise device.

While some conventional baby carriers may be capable of being carried by one hand of a user, these devices are typically heavy, unbalanced, and unwieldly, resulting in danger to the baby being carried, if attempts are made to use such devices as resistance training equipment.

A need therefore exists for a baby carrier designed for lightweight, short transport, and further configured such that it can be utilized for exercising while carrying the baby, wherein the weight of the baby serves as resistance.

SUMMARY

An aspect of the present disclosure is a baby carrier designed for easy and quick short transportation of the baby using a single hand.

Another aspect of the present disclosure is a multifunction, lightweight baby carrier configured for use as a resistance-training device suitable for a workout regimen.

A further aspect of the present disclosure is a multifunction, lightweight baby carrier, that does not comprise complicated buckles and/or fastening devices, enabling the baby to be comfortably situated within the baby carrier, with the baby's head and lower extremities fully supported by a strap, while securing the baby comfortably and easily, in a safe and secure manner, through the use of another strap for swaddling the baby within the baby carrier. The baby is thus provided with a soothing and comfortable environment, while a user employs the baby carrier and the baby as a resistance-training device.

Yet, another aspect of the present disclosure is a baby carrier that enables a user to utilize the weight of the baby for resistance training in a manner similar to a traditional dumbbell. The user is able to safely perform such resistance-training as, for example, bicep curls, side shoulder raises, front shoulder raises, upright rows, shoulder press, side bends, overhead triceps extension, as well as other techniques. Not only is the baby safe and comfortable during use, but the baby enjoys the smooth movements of the exercise.

Still, another aspect of the present disclosure is a baby carrier that is sufficiently lightweight and portable to be carried by one hand, similar to a tote bag, with the baby's head and lower extremities fully supported, the baby's body strapped into the carrier without complicated buckles or straps, and a safety strap ensuring the baby is secure and creating a soothing, swaddling sensation for the baby.

Yet a further aspect of the present disclosure is a multifunction baby carrier for safe, rapid, and convenient transportation of a baby over short distances, while also providing a portable baby swing and resistance training for a user.

Additional aspects and other features of the present disclosure will be set forth in the description which follows and in part will be apparent to those having ordinary skill in the art upon examination of the following or may be learned from the practice of the present disclosure. The advantages of the present disclosure may be realized and obtained as particularly pointed out in the appended claims.

BRIEF DESCRIPTION OF THE DRAWINGS

The present disclosure is illustrated by way of example, and not by way of limitation, in the figures of the accompanying drawing and in which like reference numerals refer to similar elements and in which.

DETAILED DESCRIPTION

Figure 1:
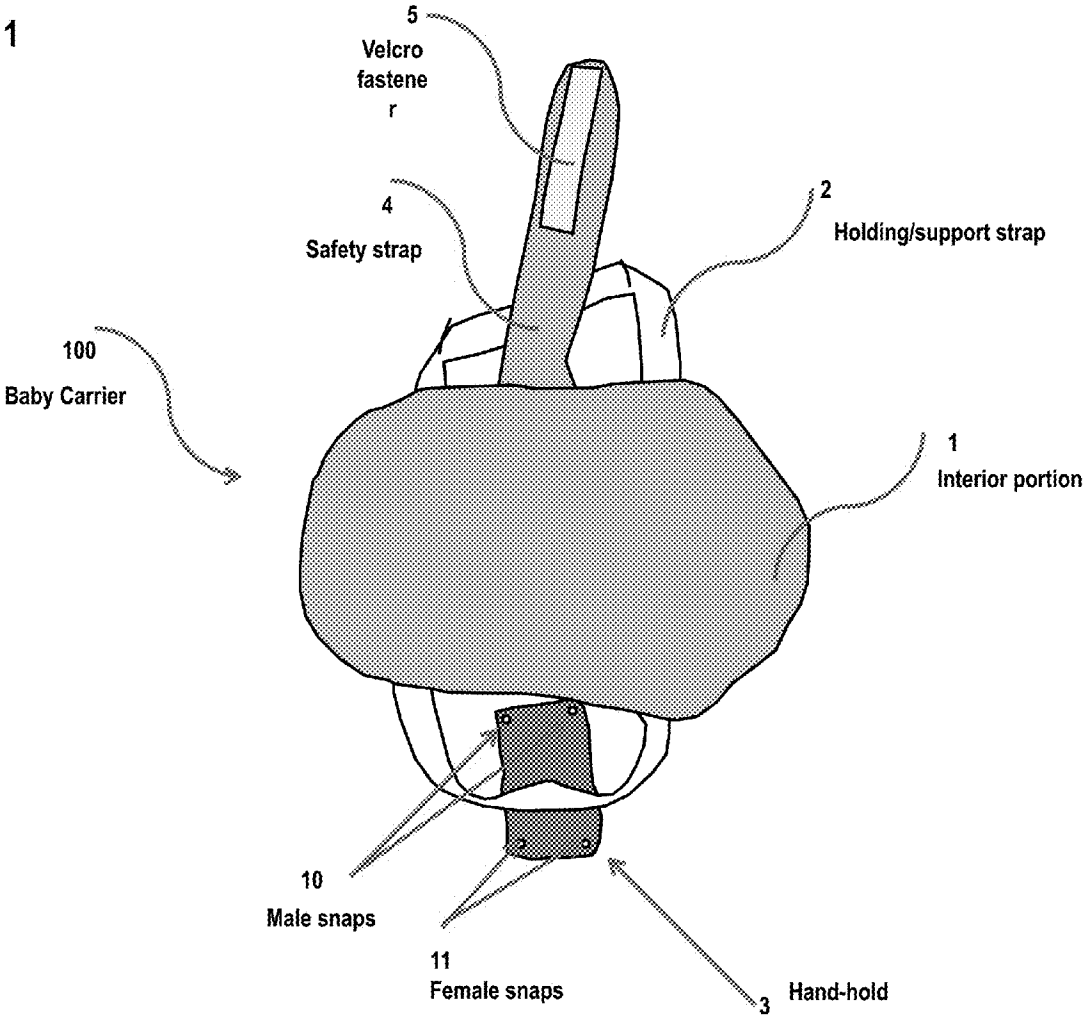
FIG. 1 schematically illustrates a top view of a baby carrier in accordance with an exemplary embodiment.

In the following description, for the purposes of explanation, numerous specific details are set forth in order to provide a thorough understanding of exemplary embodiments. It should be apparent, however, that exemplary embodiments may be practiced without these specific details or with an equivalent arrangement. In other instances, well-known structures and devices are shown in block diagram form in order to avoid unnecessarily obscuring exemplary embodiments. In addition, unless otherwise indicated, all numbers expressing quantities, ratios, and numerical properties of ingredients, reaction conditions, and so forth used in the specification and claims are to be understood as being modified in all instances by the term "about."

The present disclosure addresses and solves several deficiencies of conventional baby carriers. Conventional baby carriers of the car seat type are difficult to employ as a baby transport as they are heavy and difficult to transport with a single hand. Conventional baby carriers of the type strapped to a user's body are often lightweight, but still difficult to use for any other purpose other than transporting the baby while strapped to the user's body. The present disclosure addresses these problems by providing a multifunction baby carrier that can easily transport a baby with a single hand, and enables using the baby's weight for resistance training while keeping the baby safe and amused. The multifunction baby carrier can also be used as a portable baby swing.

In accordance with embodiments of the present disclosure the multifunction baby carrier may be placed on a flat surface with the holding/support strap and safety strap spread out to the side. The baby may then be placed into the shallow interior portion of the baby carrier, which may be fabricated of a soft, breathable material for maximum comfort to the baby. Once the baby is placed on the interior portion, portions of the holding/support straps that form loops on the sides of the interior portion may be gathered up into one hand of the user. The weight of the baby causes the baby carrier to form a hammock-like shape, thereby providing gentle pressure from the sides of the interior portion in a swaddling-like manner. The safety strap may be secured, and a hand-hold secured to the holding/support strap may be snapped into a closed position around the loop portions of the holding/support strap. The user may now safely and easily transport the baby short distances simply by holding the baby carrier in the same manner as, for example, a tote bag. The baby's head and lower extremities are supported by portions of the holding/support strap, which are located on the bottom of the baby carrier. These portions of the holding/support strap may be attached all along the bottom of the baby carrier way in order to ensure that the weight of the baby lies directly on, and supported by, the holding/support strap itself. Having the baby lying atop, and supported by, the holding/support strap itself, ensures the safety of the baby.

Once safely inside the baby carrier, the baby can be easily placed down on any surface; floor, counter, table, etc., while the baby is comfortably swaddled within the baby carrier. When transportation, amusement, and/or resistance-training is desired, the user may very quickly and easily pick up the baby simply by grabbing the loop portions of the holding/support strap.

Once the baby is secured in the baby carrier, the baby's weight may be used to exercise in a manner similar to using a dumbbell. Some of the exercises a user can perform include, but are not limited to, biceps curls, side shoulder raises, front shoulder raises, upright rows, and many more.

The multifunction baby carrier may also be employed as a portable baby swing to soothe a crying or fidgety baby by swinging the lightweight baby carrier in a pendulum-like movement, to and fro, using one hand.

Still other aspects, features, and technical effects will be readily apparent to those skilled in this art from the following detailed description, wherein preferred embodiments are shown and described, simply by way of illustration of the best mode contemplated. The disclosure is capable of other and different embodiments, and its several details are capable of modifications in various obvious respects. Accordingly, the drawings and description are to be regarded as illustrative in nature, and not as restrictive.

Adverting to FIG. 1, a top view of the baby carrier 100 is illustrated. In particular, FIG. 1 illustrates an interior portion 1 of a baby carrier 100, a holding/support strap 2, a hand-hold 3 attached to one loop of the holding/support strap 2, and a safety strap 4, the safety strap 4 including a Velcro™ strip 5.

The interior portion 1 may be generally oval in shape, but may also be formed in various other shapes. The interior portion 1 may be manufactured of any soft, breathable, and, preferably washable, material. In one embodiment, a felt or flannel material is used, but those of ordinary skill in the art will appreciate that many fabrics may be employed. An easily washable fabric is desirable, because the baby may easily soil the fabric in several ways. It is desirable to use a soft and comfortable material to provide comfort to a baby placed therein.

Figure 2:
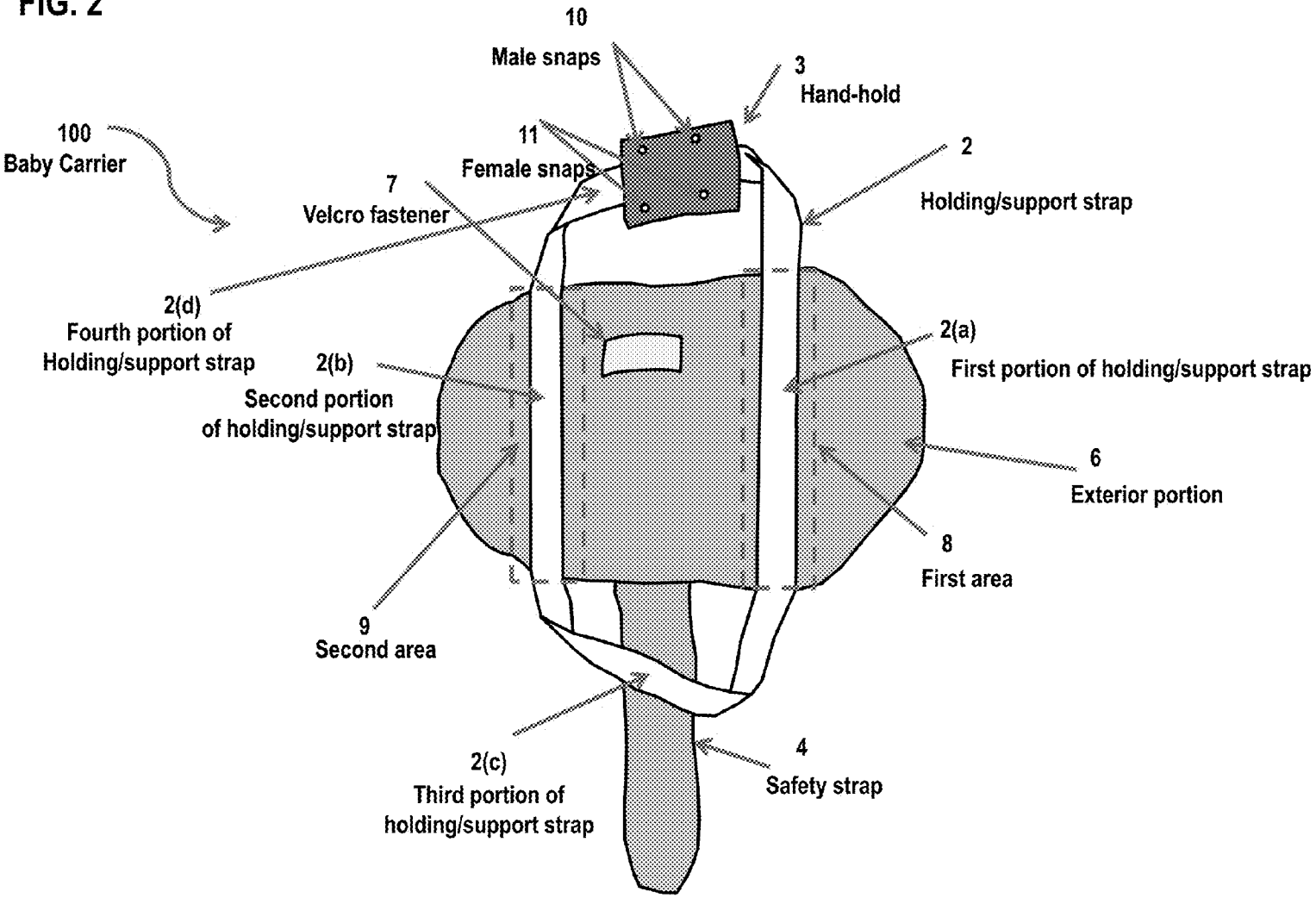
FIG. 2 schematically illustrates a bottom view of the baby carrier in accordance with an exemplary embodiment.

Holding/support strap 2 may be attached to the baby carrier 100 all along the exterior portion 6 of the baby carrier. As shown in FIG. 2, holding/support strap 2 may be a single, continuous strip of strap in the form of an unending loop. However, the holding/support strap 2 may also comprise separate, discontinuous straps. As shown in FIG. 2, the holding/support strap may comprise a first portion 2(*a*), a second portion 2(*b*), a third portion 2(*c*), and a fourth portion 2(*d*). Portions 2(*a*) and 2(*b*) may be permanently attached to the exterior portion 6 along the width of the baby carrier 100. Portion 2(*a*) may be attached along the width of baby carrier 100 in a first area 8 of the exterior portion 6 and portion 2(*b*) may be attached along the width of baby carrier 100 in a second area 9 of the exterior portion 6, areas 8 and 9 shown as dashed lines in FIG. 2. Areas 8 and 9 may be chosen to correspond to areas that will support the baby's head and lower extremities, respectively. The attachment of the first portion 2(*a*) and second portion 2(*b*) of the holding/support strap may be made, for example, by sewing the first portion 2(*a*) and second portion 2(*b*) onto the exterior portion 6 of baby carrier 100. However, as understood by those of ordinary skill in the art, the attachment of holding/support strap 2 to the exterior portion 6 of the baby carrier 100 may be made by any other suitable means, whereby a strong bond is made between the first portion 2(*a*) and second portion 2(*b*) of holding/support strap 2 and the exterior portion 6 of baby carrier 100. The holding/support strap 2 may be made of a strong, yet soft and lightweight material. In an exemplary embodiment, the holding/support strap is made of a canvas material, but other known materials could serve a similar purpose without departing from the broader spirit and scope of the present disclosure. Alternatively, the entire baby carrier can be formed as an integral unit in any convenient manner.

The interior portion 1 and the exterior portion 6 may be made of the same material, similar materials, or of completely different materials. In one aspect, the interior portion 1 may be formed of any soft, breathable, and, preferably washable, material, such as felt, while the exterior portion 6 is formed of a stronger, but lightweight, washable, and tear-resistant material, such as denim. In forming the baby carrier 100, the interior portion 1 and the exterior portion 6 may then be sewn together, or attached in any other known manner, with a batting material optionally provided therebetween for cushioning the baby.

Figure 3:
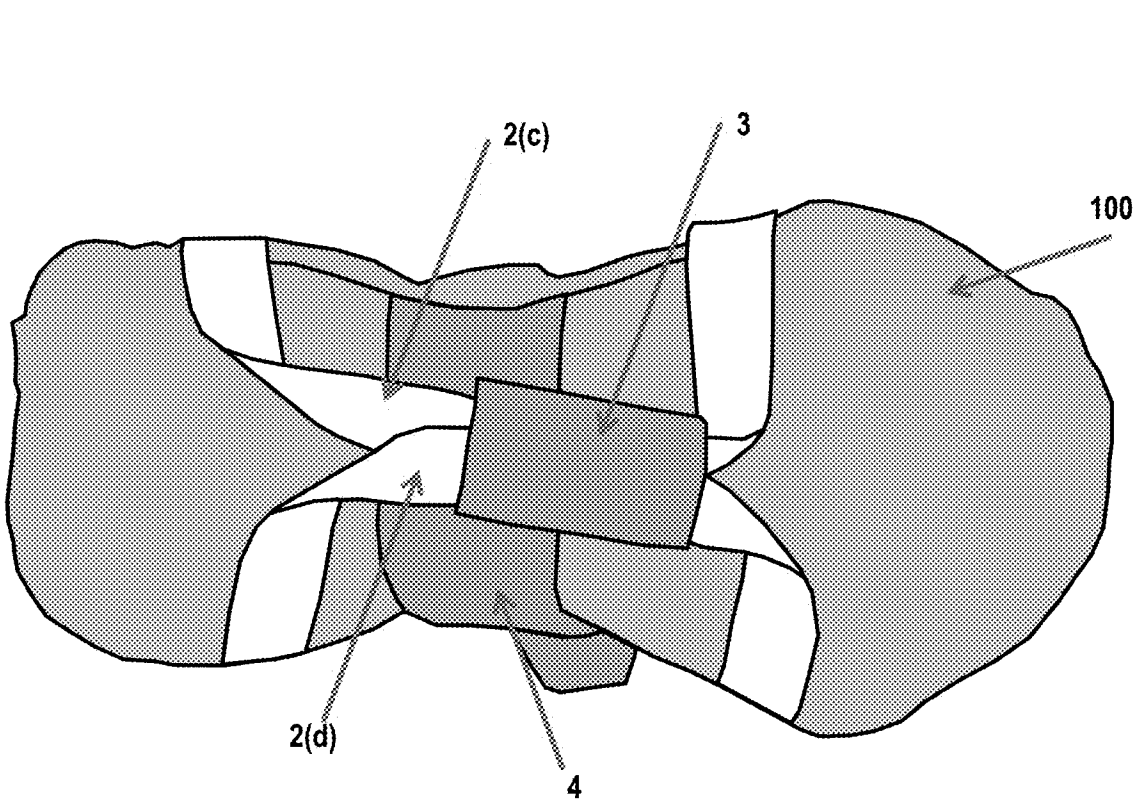
FIG. 3 schematically illustrates a top view of the baby carrier, without the baby, in accordance with an exemplary embodiment.

Adverting to FIG. 3, baby carrier 100 is illustrated with the safety strap 4 pulled across the top of the baby carrier 100 and attached by connecting Velcro™ strip 5 on the safety strap to Velcro™ strip 7 (as shown in FIG. 2) on the exterior portion 6, and with the hand-hold 3 wrapped around the third portion 2(*c*) and the fourth portion 2(*d*) of the holding/support strap 2. Thus, FIG. 3 illustrates the position of the baby carrier as it would look in use, omitting the baby for illustrative convenience. Loops of the holding strap are held together and a securing strap is secured across the top the baby carrier when in actual use.

The hand-hold 3 may be made of a material similar to the exterior portion 6. In a preferred embodiment, the hand-hold is made of denim, but other materials may be employed without departing from the broader spirit and scope of the present disclosure. The hand-hold 3 is desirably sewn onto fourth portion 2(*d*) of holding/support strap 2 so that it is permanently attached thereto to prevent loss and to be readily available for wrapping around the third portion 2(*c*) and the fourth portion 2(*d*) of the holding/support strap 2 for an easy and comfortable grip for a user while carrying the baby carrier or using it as a resistance training device. The hand-hold 3 may be formed, for example with four snaps (two male snaps 10 and two female snaps 11) for an easily attachable/detachable connection when the hand-hold 3 is wrapped around the third portion 2(*c*) and the fourth portion 2(*d*) of the holding/support strap 2, but other means of attaching/detaching the hand-hold 3 (Velcro™, zipper, ties, buttons, etc.) may be used without departing from the broader spirit and scope of the present disclosure. The hand-hold may also be padded or unpadded.

Figure 4:
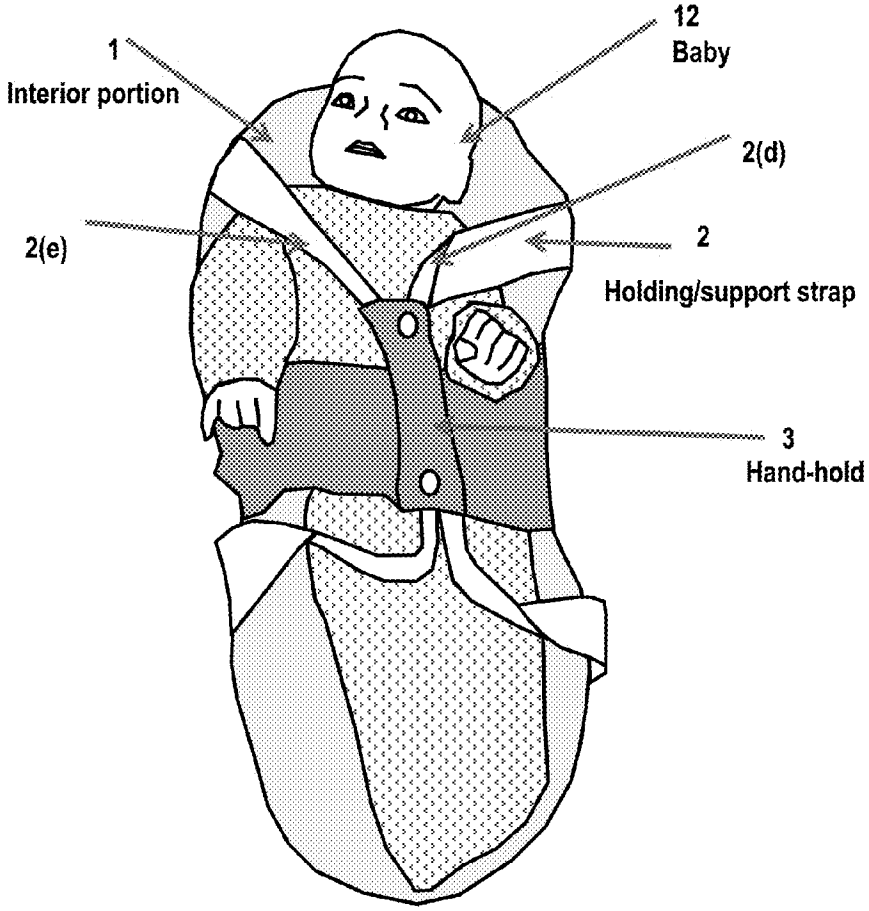
FIG. 4 schematically illustrates a view of the baby carrier with a baby secured therein, in accordance with an exemplary embodiment.
Figure 5:
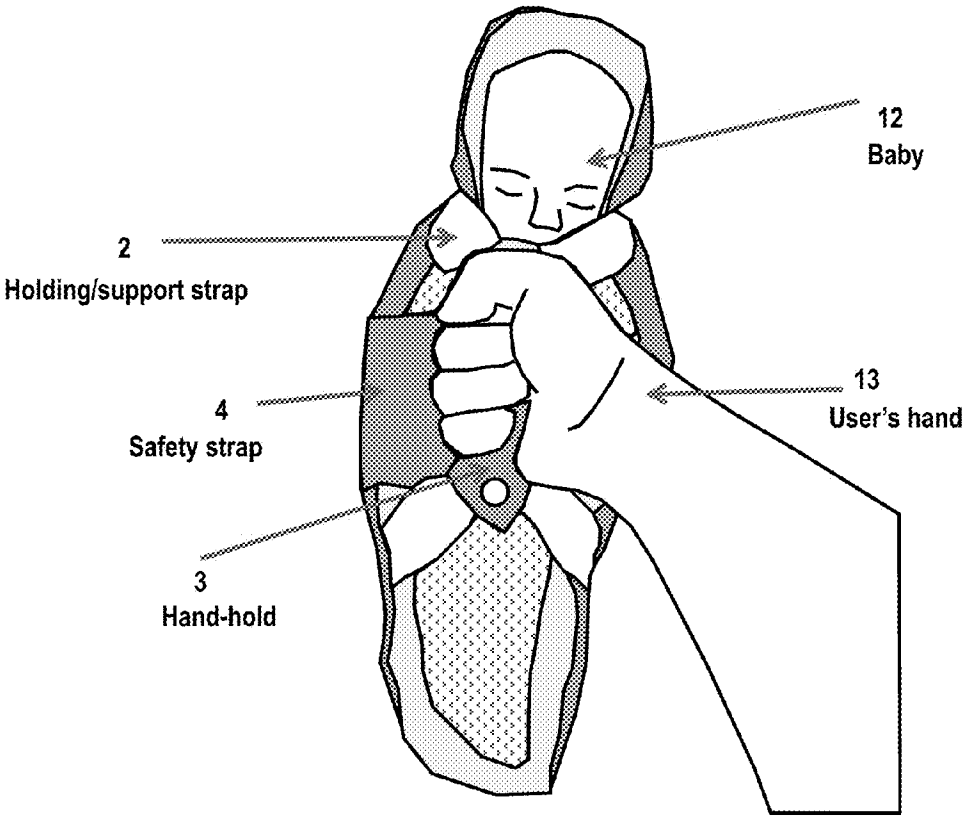
FIG. 5 schematically illustrates a baby carrier with a baby swaddled therein in accordance with an exemplary embodiment.

As illustrated in FIG. 4, a baby 12 may be placed within the baby carrier 100, with the hand-hold 3 wrapped around the third portion 2(*c*) and the fourth portion 2(*d*) of the holding/support strap 2, and the safety strap 4 may be placed over the baby 12. The baby 12 may be placed entirely within the baby carrier 100 and no part of the baby overhangs the baby carrier 100. Thus, when the user's hand 13 grasps the hand-hold 3 and lifts the baby carrier 100 with the baby 12 there inside, the baby is completely swaddled inside the baby carrier 100, with the baby's head/neck fully supported by the first portion 2(*a*) of holding/support strap 2 and the baby's lower extremities fully supported by the second portion 2(*b*) of holding/support strap 2, as shown in FIG. 5.

In accordance with aspects of the present disclosure, a swaddled baby is kept comfortable. As is generally understood by parents, pediatricians, and others skilled in the art of caring for babies, a swaddled baby feels safe, warm, and comfortable, with an overall feeling of well-being. In addition, the baby carrier 100 acts as an inexpensive, lightweight, convenient, and safe device for carrying the baby while moving from one location to another, while providing for easy maintenance and washability of the baby carrier.

The multifunction baby carrier may be used for exercising, e.g., resistance training exercising. In this manner, a user, e.g., a parent, may reap the benefits of daily resistance training while caring for a baby. The baby carrier 100 is useful for babies from newborns to about 4 months old, depending on the length of the baby, the weight of the baby, and the fidgetiness of the baby. Because many babies enjoy the feeling of movement, while either awake or sleeping, the baby carrier 100 acts to soothe the baby while the user enjoys a vigorous workout.

As illustrated in FIG. 6 through FIG. 9, various, though not exhaustive, examples of resistance training exercises may be performed by using the baby carrier 100.

Figure 6:
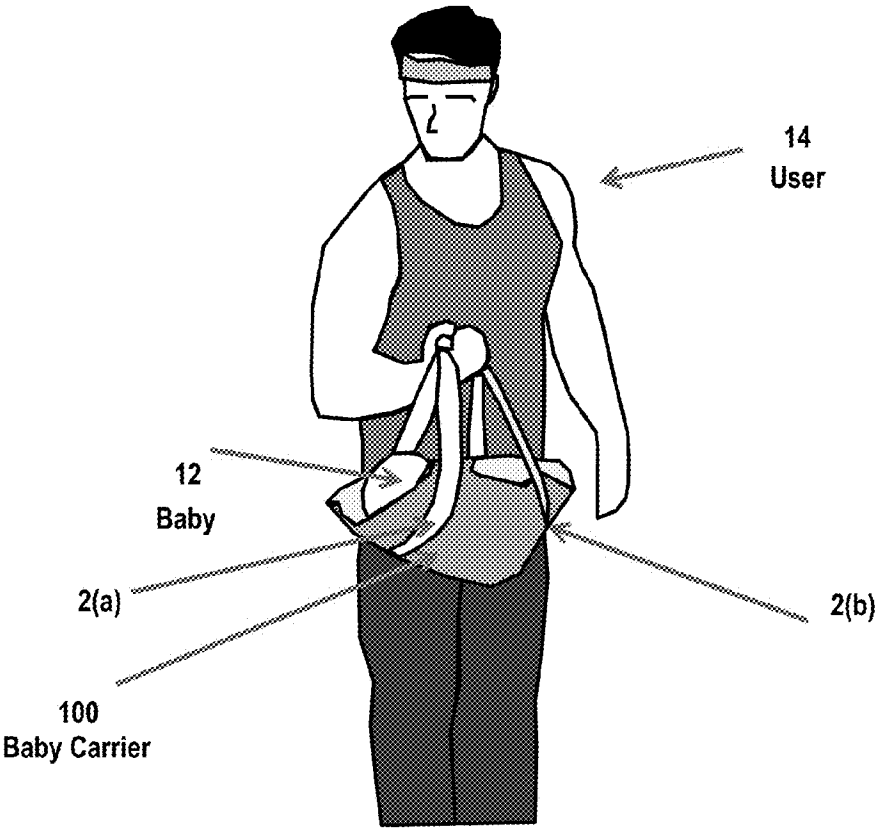
FIG. 6 schematically illustrates a user employing the baby carrier to perform bicep curls in accordance with an exemplary embodiment.

Adverting to FIG. 6, a user 14 may employ baby carrier 100 as a bicep curling device, while the baby 12 rests comfortably within the baby carrier 100, with the baby's head supported by portion 2(*a*) of holding/support strap 2 and the baby's lower extremities being supported by portion 2(*b*) of holding/support strap 2.

Figure 7:
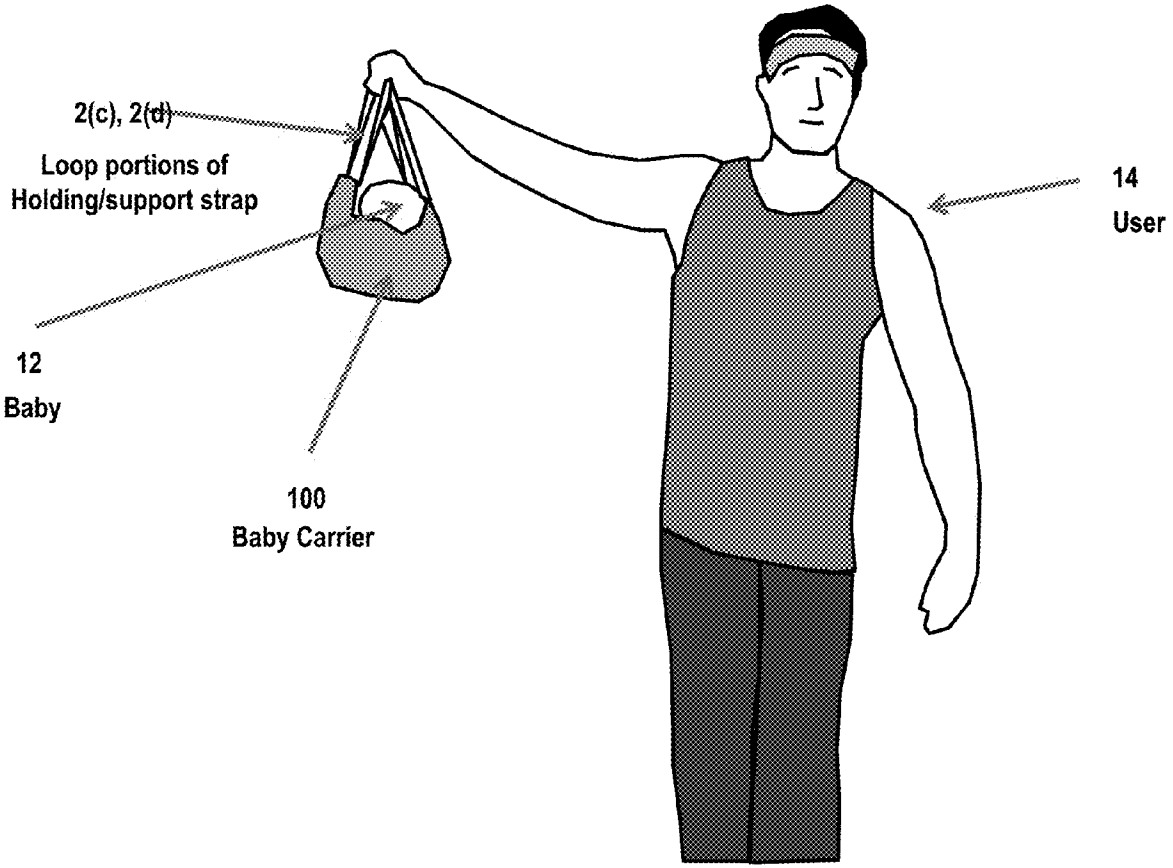
FIG. 7 schematically illustrates a user employing the baby carrier to perform side shoulder raises in accordance with an exemplary embodiment.

Adverting to FIG. 7, a user 14 may employ the baby carrier 100 to perform side shoulder raises, while the baby 12 rests comfortably within the baby carrier 100, with the baby's head supported by portion 2(*a*) of holding/support strap 2 and the baby's lower extremities being supported by portion 2(*b*) of holding/support strap 2.

Figure 8:
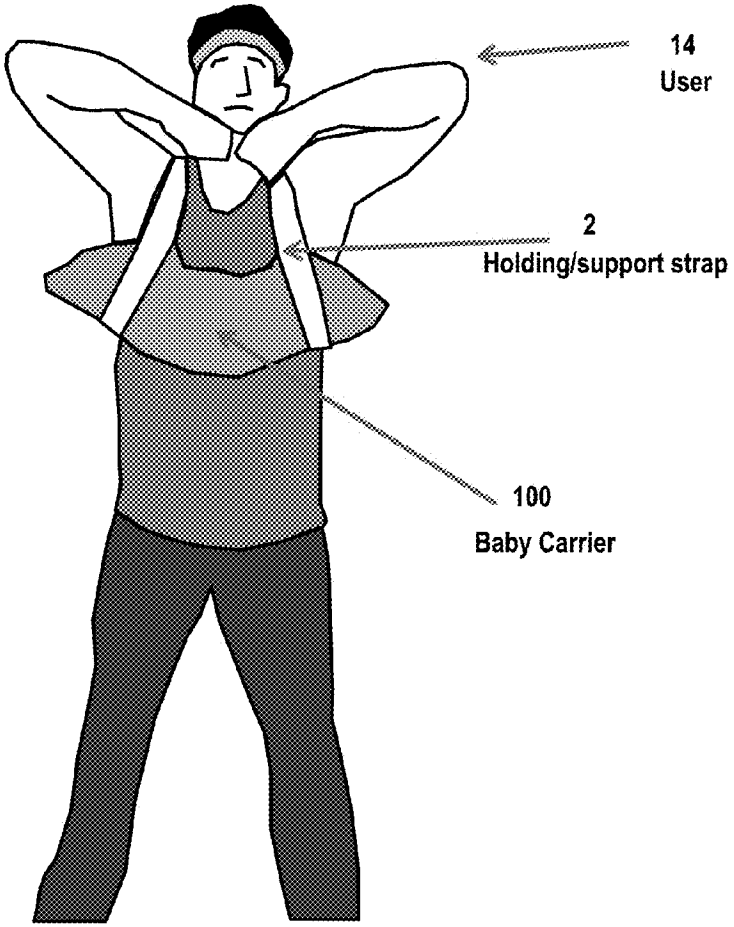
FIG. 8 schematically illustrates a user employing the baby carrier to perform upright rows in accordance with an exemplary embodiment.

Adverting to FIG. 8, a user 14 may employ the baby carrier 100 to perform upright rows, while the baby 12 rests comfortably within the baby carrier 100, with the baby's head supported by portion 2(*a*) of holding/support strap 2 and the baby's lower extremities being supported by portion 2(*b*) of holding/support strap 2.

Figure 9:
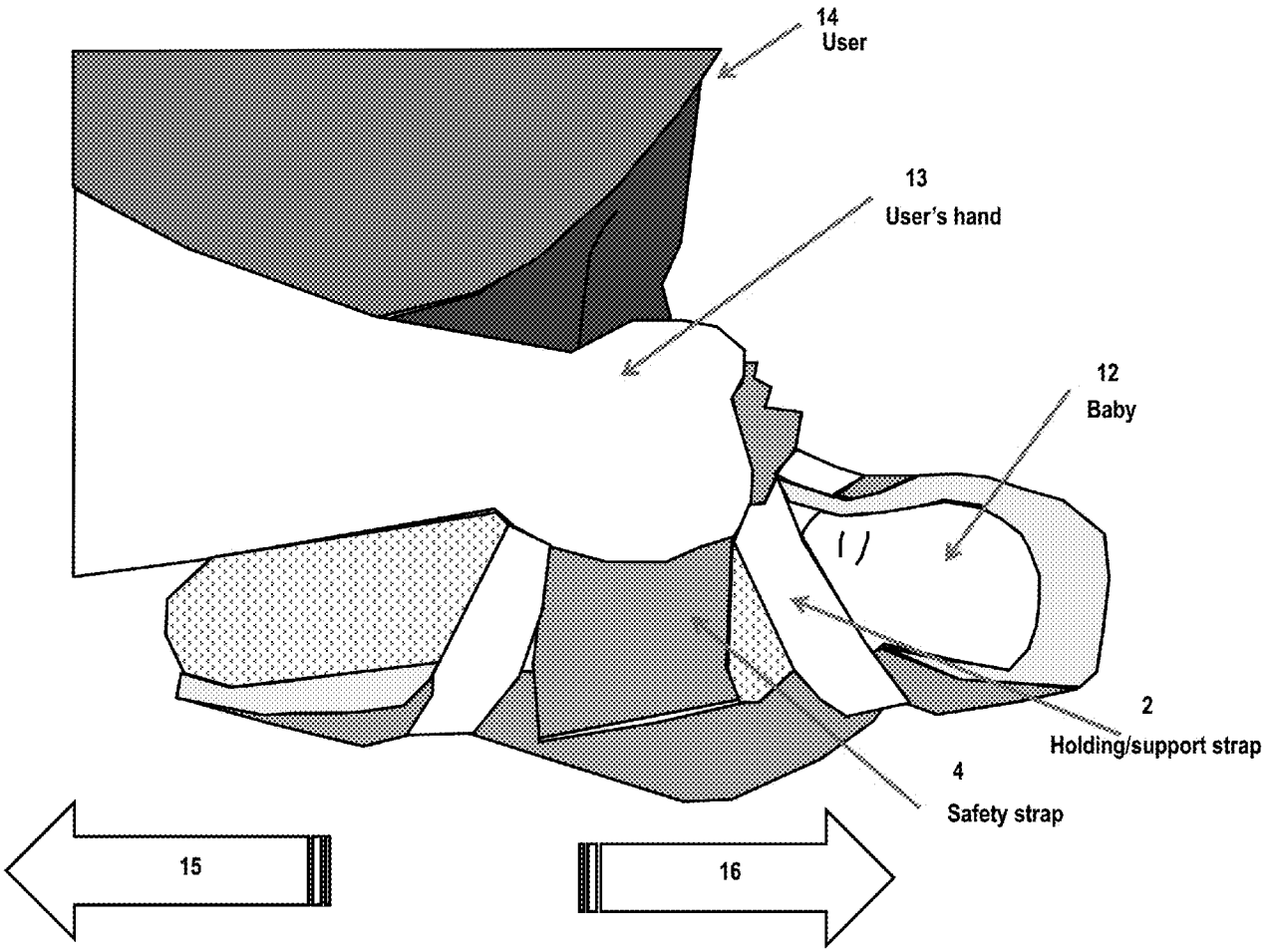
FIG. 9 schematically illustrates a baby carrier being carried with a baby swaddled therein in accordance with an exemplary embodiment.

As illustrated in FIG. 9, a user 14 may employ the baby carrier 100 as a free weight, with the user's hand 13 gripping the hand-hold 3, while the baby 12 is swaddled and supported within the baby carrier 100, with the safety strap 4 in place. By moving the baby carrier 100 back and forth, either linearly, as illustrated by arrows 15 and 16, or in a shallow arc, as in a pendulum-like motion, the user 14 may implement the baby carrier 100 as a portable baby swing. The to and fro motion provided when using the baby carrier as a portable swing soothes and comforts the baby swaddled within the carrier.

The dimensions of the baby carrier 100 and of the elements therein are variable, and may vary with the size of the baby intended to be carried. However, the following dimensions have been found to accommodate most babies from newborn to about 4 months of age:

Length of the interior portion 1 and the exterior portion 6: about 24"-30".

Width of the interior portion 1 and the exterior portion 6: about 12"-15".

Width of holding/support strap 2: about 1½"-2".

Width of the safety strap 4: about 3½"-5'.

Length of the safety strap 4: about 14'-16".

The embodiments of the present disclosure can achieve several technical effects, with a multi-purpose baby carrier providing a lightweight, portable baby transporter, a device that enables a user to exercise using the baby's weight for resistance-training, while simultaneously providing care for a baby, and a portable baby swing for soothing and comforting a baby.

In the preceding description, the present disclosure is described with reference to specifically exemplary embodiments thereof. It will, however, be evident that various modifications and changes may be made thereto without departing from the broader spirit and scope of the present disclosure, as set forth in the claims. The specification and drawings are, accordingly, to be regarded as illustrative and not as restrictive. It is understood that the present disclosure is capable of using various other combinations and embodiments and is capable of any changes or modifications within the scope of the inventive concept as expressed herein.

What is claimed is:

1. An apparatus, comprising:

a first part configured to accommodate an animal, the first part comprising an interior portion, an exterior portion, an anterior portion for placing the animal's head, and a posterior portion for placing the animal's lower extremities;

a second part configured to both support the animal and provide a grasp for at least one hand of a user, wherein the second part comprises a strap having first, second, third, and fourth portions, the first portion securely fastened to and directly contacting the exterior portion of the first part continuously all along a first area of the exterior portion of the first part, the second portion securely fastened to and directly contacting the exterior portion of the first part continuously all along a second area of the exterior portion of the first part; and the third and fourth portions each forming a loop extending from one of the edges on opposite sides of the first part; and a third part configured to swaddle the animal within the first part, wherein the first part consists of foldable fabric and comprises first and second edges and the first and second edges are caused to approach each other to form a hammock-like shape to further swaddle the animal when the user holds the grasp and lifts the apparatus, wherein the entire first part between the first and second edges provides a non-rigid surface for supporting the animal and is capable of being foldable around the animal, and wherein the first area of the exterior portion of the first part is juxtaposed with the anterior portion of the first part, and the second area of the exterior portion of the first part is juxtaposed with the posterior portion of the first part.

2. The apparatus according to claim 1, wherein the interior portion is formed of a soft, breathable material.

3. The apparatus according to claim 1, wherein the exterior portion is formed of a tear- and abrasion-resistant material.

4. The apparatus according to claim 1, wherein the third part comprises a safety strap securely attached to the first edge and extendable from the point of secure attachment to the second edge across and over the interior portion of the first part and configured to confine and swaddle the human body within the interior portion of the first part by releasably attaching the extended portion of the safety strap to the second edge.

5. The apparatus according to claim 4, wherein the extended portion of the safety strap is releasably attached using a Velcro fastener.

6. The apparatus according to claim 1, wherein:

the first part is configured to accommodate a human body, the human body being swaddled in the interior portion; and wherein the first portion of the strap is configured to support a neck of the human body; the second portion of the strap is configured to support lower extremities of the human body, and the third and fourth portions of the strap are configured to be held by the at least one hand of the user.

7. The apparatus according to claim 6, Wherein the strap comprises a single piece of material.

8. The apparatus according to claim 7, wherein the material comprises a continuous loop.

9. The apparatus according to claim 6, further comprising a hand hold attached to one of the third and fourth portions and configured to releasably attach the third and fourth portions.

10. The apparatus according to claim 6, wherein the human body is a baby and the weight of the baby is used for resistance training exercises by the user.

11. Art apparatus, comprising:

a first part comprising first and second edges, an interior portion, an exterior portion, an anterior portion for placing the head of a human body, and a posterior portion for placing the lower extremities of the human body, and configured to accommodate the human body in the interior portion, the first part consisting of foldable fabric and lying substantially flat in a first configuration;

a second part comprising a strap comprising one continuous loop with a first portion securely fastened to and directly contacting the exterior portion of the first part continuously all along a first area of the exterior portion of the first part, a second portion securely fastened to and directly contacting the exterior portion of the first part continuously all along a second area of the exterior portion of the first part, the strap configured to both support the human body and provide a grasp for at least one hand of a user; and a third part configured to swaddle the human body within the first part, the first part assuming a second configuration, different from the first configuration, upon the third part being configured to swaddle the human body, wherein the first and second edges are caused to approach each ether to form a hammock-like shape to further swaddle the human body when the user holds the grasp and lifts the apparatus, wherein the entire first part between the first and second edges provides a non-rigid surface for supporting the human body and is capable of being foldable around the human body, and wherein the first area of the exterior portion of the first part is juxtaposed with the anterior portion of the first part, and the second area of the exterior portion of the first part is juxtaposed with the posterior portion of the first part.

12. The apparatus according to claim 11, wherein the first portion of the strap is configured to support a neck of the human body and the second portion of the strap is configured to support the lower extremities of the human body.

13. The apparatus according to claim 11, wherein the second part and the third part comprise a fabric material.

* * * * *